US005132740A

United States Patent [19]

Okamoto et al.

[11] Patent Number: 5,132,740

[45] Date of Patent: Jul. 21, 1992

[54] WASTE TONER COLLECTING DEVICE FOR AN IMAGE RECORDER

[75] Inventors: Keiji Okamoto; Chuji Ishikawa, both of Yokohama, Japan

[73] Assignee: Ricoh Company, Ltd., Tokyo, Japan

[21] Appl. No.: 708,168

[22] Filed: May 31, 1991

[30] Foreign Application Priority Data

Jun. 1, 1990 [JP] Japan ..... 2-57251[U]

[51] Int. Cl.[5] ..... G03G 21/00

[52] U.S. Cl. ..... 355/298; 141/346; 141/351; 141/383

[58] Field of Search ..... 355/298; 222/DIG. 1, 222/162; 141/326, 330, 346, 348, 349, 350, 351, 352, 383, 386

[56] References Cited

U.S. PATENT DOCUMENTS 4,325,628 4/1982 Torigai et al. ..... 355/298
4,849,791 7/1989 Hagihara et al. ..... 355/298
4,982,231 1/1991 Matsunchi ..... 355/298 X

FOREIGN PATENT DOCUMENTS 0251823 1/1988 European Pat. Off. .
0272486 6/1988 European Pat. Off. .
2952424 2/1984 Fed. Rep. of Germany .
62-163085 7/1987 Japan .
62-200386 9/1987 Japan .
62-283378 12/1987 Japan .

*Primary Examiner*—Joan H. Pendegrass
*Assistant Examiner*—Shuk Lee
*Attorney, Agent, or Firm*—Oblon, Spivak, McClelland, Maier & Neustadt

[57] ABSTRACT

A device incorporated in an electrophotographic image recorder for collecting toner particles, paper dust and so on which are removed from a photoconductive element by a cleaning device. The collecting device is constructed independently of the cleaning device. In a portion where the collecting device and cleaning device are connected to each other, a first and a second shutter which open and close respectively an opening formed through the cleaning device and an opening formed through the collecting device cooperate with each other. When the collecting device is connected to the cleaning device, the second shutter unblocks the associated opening before the first shutter does so. Conversely, when the collecting device is disconnected from the cleaning device, the second shutter blocks the associated opening after the first shutter has done so.

3 Claims, 4 Drawing Sheets

WASTE TONER COLLECTING DEVICE FOR AN IMAGE RECORDER

BACKGROUND OF THE INVENTION

The present invention relates to an electrophotographic image recorder and, more particularly, to a device incorporated in such an image recorder for collecting a waste toner and constructed independently of a cleaning device.

An electrophotographic copier, facsimile transceiver, laser printer or similar electrophotographic image recorder has an optical writing device for electrostatically forming a latent image on a photoconductive element, and a developing device for developing the latent image by a toner or developer. The resulted toner image is transferred to a recording medium in the form of a paper sheet by an image transferring device. Thereafter, the toner image on the sheet is fixed by a fixing device. After the image transfer, a cleaning device implemented as a blade removes toner particles, paper dust and so on remaining on the photoconductive element. The toner so removed from the photoconductive element, i.e., waste toner is collected in a receptacle together with the paper dust.

It has been customary to construct the above-mentioned receptacle integrally with the cleaning device. Such a configuration has a problem that when the receptacle is filled with the waste toner, not only the receptacle but also the cleaning device has to be bodily removed from the body of the recorder to discard the waste toner. Since the receptacle filled with the waste toner is heavy, removing it together with the cleaning device is troublesome. Moreover, it is likely that the waste toner is scattered around or dropped in the recorder during the removing operation, smearing the interior of the recorder.

SUMMARY OF THE INVENTION

It is therefore an object of the present invention to provide a waste toner collecting device for an image recorder which facilitates the disposal of waste toner and frees the interior of the recorder from contamination ascribable to waste toner.

It is another object of the present invention to provide a generally improved waste toner collecting device for an image recorder.

A device incorporated in an electrophotographic image recorder for collecting a waste toner, paper dust and so on which are removed from a photoconductive element by a cleaning device of the present invention comprises a first opening formed through the casing of the cleaning device for dropping the waste toner, paper dust and so on removed from the photoconductive element, an accommodating member constituting a receptacle for accommodating the waste toner, paper dust and so on dropped through the first opening, a portion of the accommodating member being configured as a connecting portion for connecting the accommodating member to the cleaning device, a second opening formed through the connecting portion of the accommodating member for allowing the waste toner, paper dust and so on dropped through the first opening to enter the receptacle, a first shutter for blocking and unblocking the first opening of the cleaning device and formed with a third opening, and a second shutter for opening and closing the second opening of the accommodating member. The first shutter and second shutters each blocks and unblocks in interlocked relation to the connecting and disconnecting operations of the accommodating member and cleaning device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
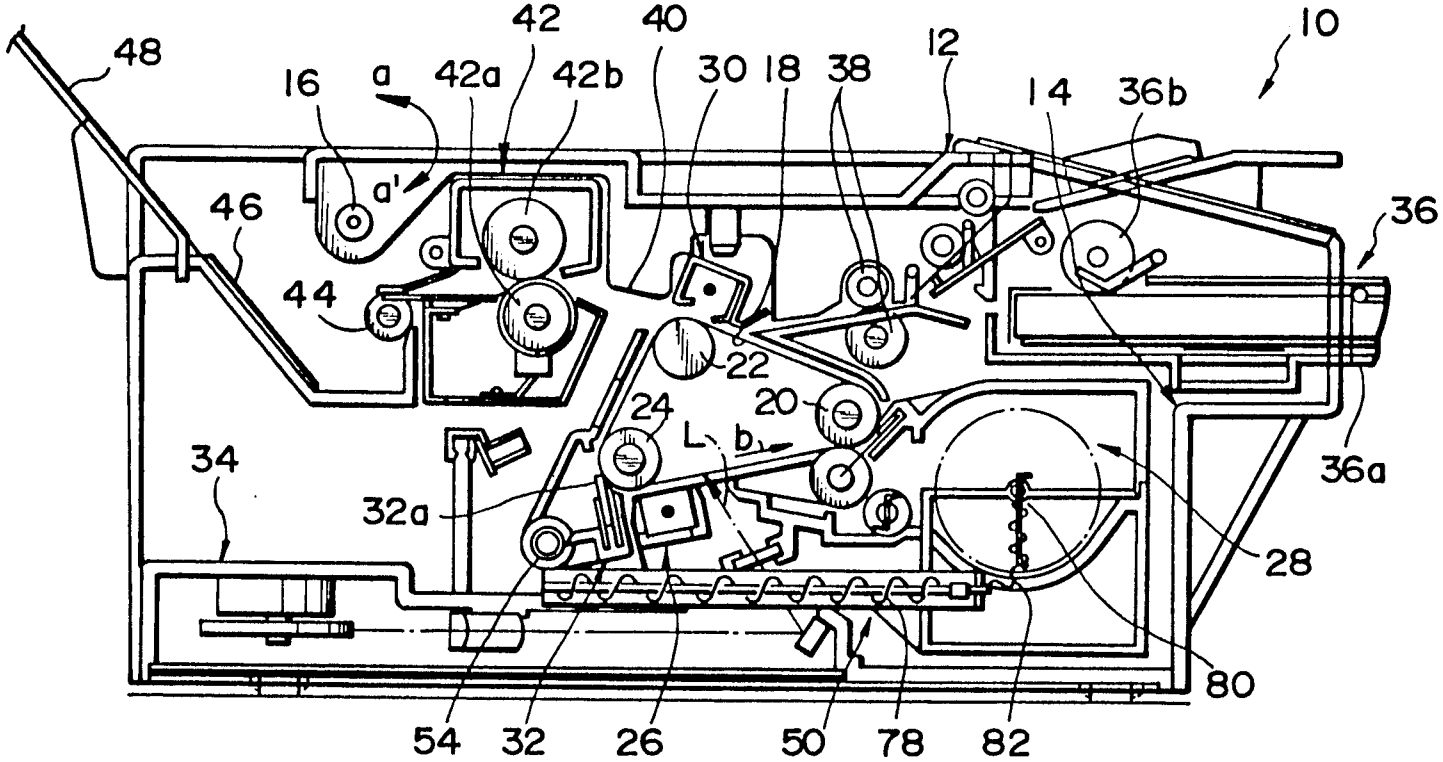
FIG. 1 is a section showing a laser printer belonging to a family of image recorders and to which a waste toner collecting device embodying the present invention is applied.

Referring to FIG. 1 of the drawings, a laser printer to which a toner collecting device embodying the present invention is applied is shown. As shown, the printer, generally 10, has an upper casing 12 and a lower casing 14. The upper casing 12 is hinged to the lower casing 14 by a shaft 16 to be rotatable, or openable, as indicated by an arrow a—a'. A photoconductive element in the form of a belt 18 is located substantially at the center of the printer 10. The belt 18 is rotated in a direction indicated by an arrow b by a drive roller 20, a tension roller 22, and a driven roller 24. Various electrophotographic process means such as a charger 26, a developing device 28, an image transferring device 30 and a cleaning device 32 with a blade **32*a* are sequentially arranged around the belt 18 in this order in the direction b. Disposed in a lower portion of the printer 10 are an optical writing device or laser writing device 34 and a waste toner collecting device 50 which will be described. A paper feeding device 36 is positioned at the right-hand side in the printer 10 and has a paper cassette 36*a***.

In operation, a paper sheet is fed from the paper cassette **36*a* by a feed roller 36*b* and then driven toward the belt 18 by a register roller pair 38 at a predetermined timing. While the belt 18 is rotated counterclockwise (direction b), the charger 26 charges the surface of the belt 18. The optical writing device 34 illuminates the charged surface of the belt 18 with a laser beam L to form a latent image thereon. The developing unit 28 develops the latent image by a toner or developer to produce a toner image. The image transferring device 30 transfers the toner image to the lower surface of the paper sheet being transported by the belt 18. The paper sheet carrying the toner image thereon is guided by a guide 40 to between a fixing roller 42*a* and a pressing roller 42*b*, whereby the toner image is fixed on the paper sheet. The paper sheet coming out of the fixing device 42 is driven by a discharge roller 44 to a guide 46 and then stacked on a tray 48. The toner, paper dust and so on remaining on the belt 18 after the image transfer are scraped off by the cleaning blade 32*a* and then collected in a receptacle 50 which is independent of the cleaning device 32**.

Figure 2:
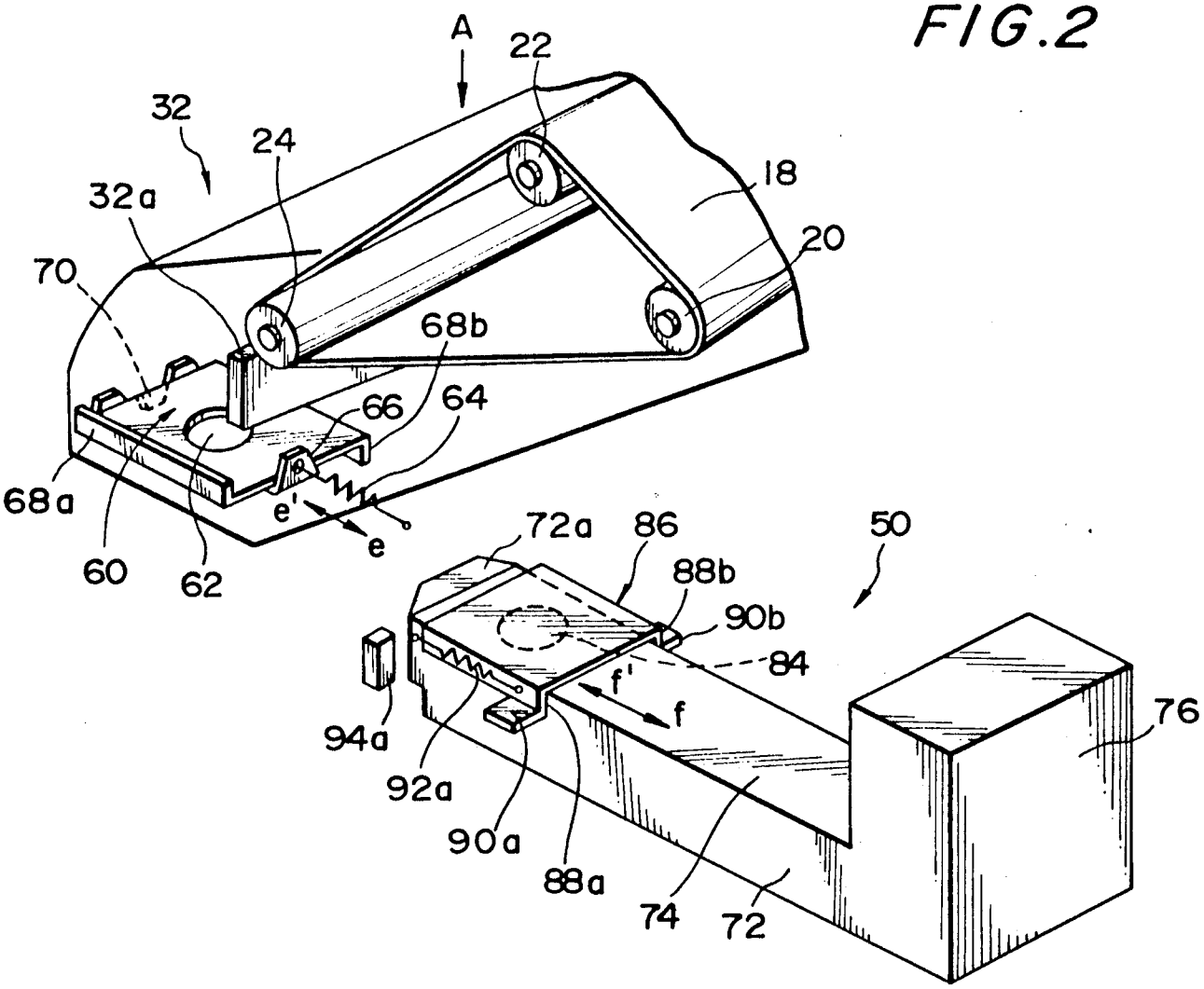
FIG. 2 is a perspective view showing the embodiment together with a cleaning device, particularly an arrangement for connecting them to each other.
Figure 3:
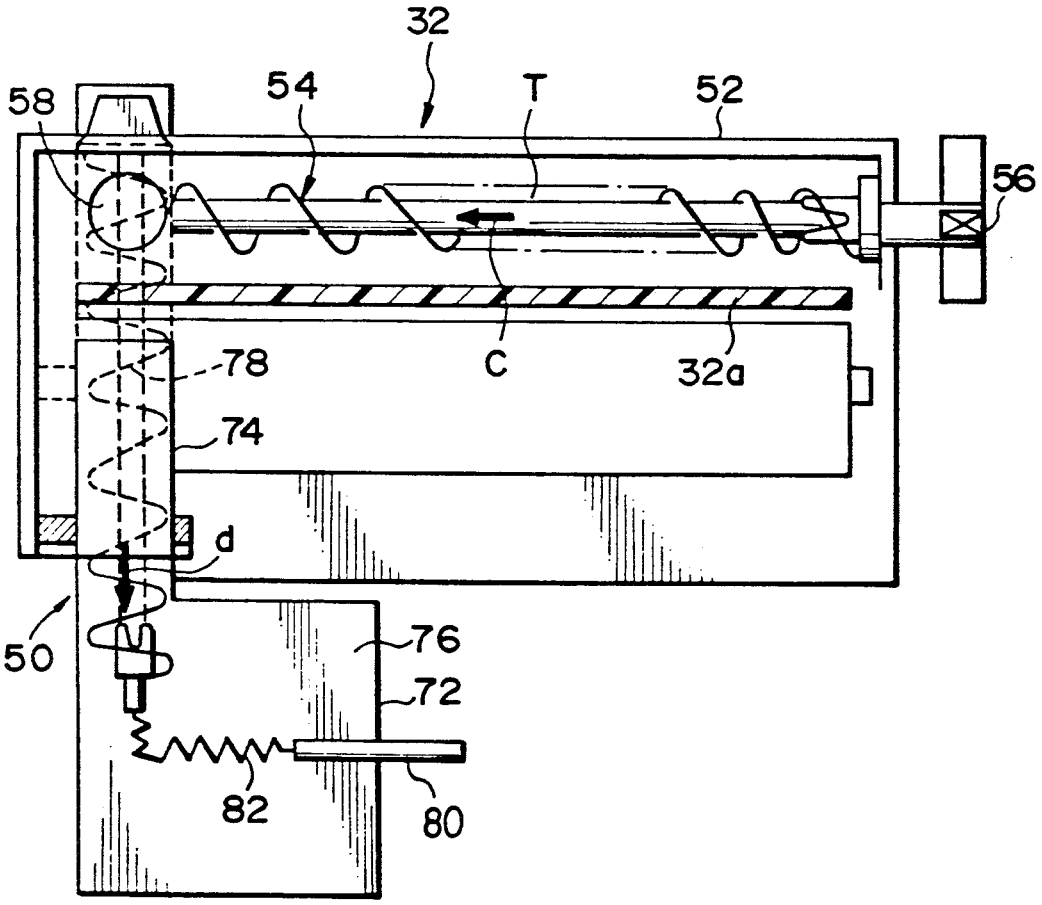
FIG. 3 is a plan view as seen in a direction A of FIG. 2.
Figure 4A:
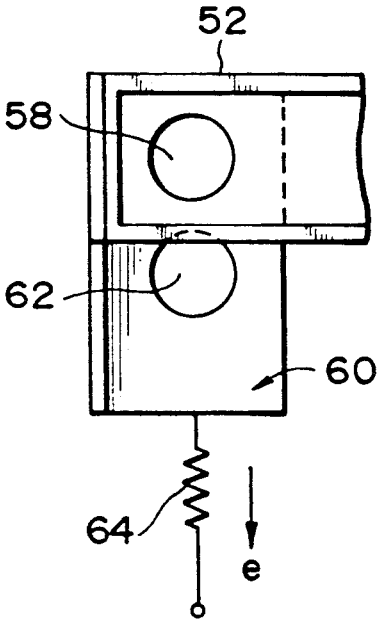
FIGS. 4A and 4B are fragmentary views demonstrating how a first shutter included in the cleaning device is operated.
Figure 4B:
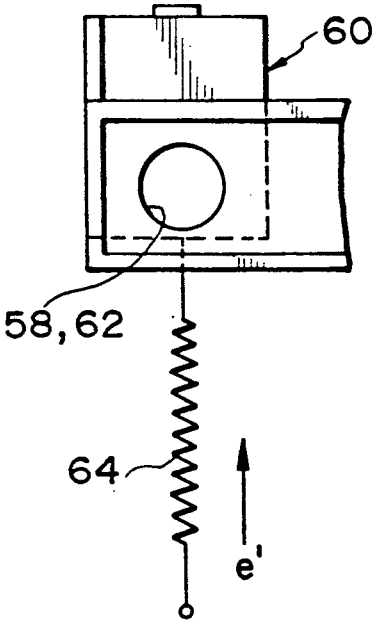

FIGS. 2 and 3 show the waste toner collecting device 50 embodying the present invention together with the cleaning device 32, particularly an arrangement for connecting them to each other. As shown in FIG. 3, the cleaning device 32 has a casing 52 accommodating therein a first screw 54 for conveying a waste toner T in a direction indicated by an arrow c and a gear 56 for rotating the screw 54. The casing 52 has an opening 58 for dropping the waste toner having been conveyed by the first screw 54. The opening 58 has a diameter $D_1$. As shown in FIG. 2, the casing 52 also has a first shutter 60 for blocking and unblocking the opening 58. The first shutter 60 has an opening 62 capable of aligning with the opening 58 of the casing 52. As shown in FIG. 4A, when the waste toner collecting device 50 is not connected to the cleaning device 32, the first shutter 60 is constantly pulled by a spring 64 in a direction indicated by an arrow e, maintaining both of the openings 58 and 62 closed. As shown in FIG. 4B, when the collecting device 50 is connected to the cleaning device 32, the first shutter 60 is moved in a direction e' against the action of the spring 64. Then, the openings 58 and 62 are brought into alignment, i.e., they are opened.

Referring again to FIG. 2, the spring 64 is anchored at one end to a lug 66 formed by bending the first shutter 60 and at the other end to part of the casing 52 of the cleaning device 32. Walls **68*a* and 68*b* also formed by bending the first shutter 60 extend in opposite directions to each other, and each is received in a guide channel, not shown, formed in the cleaning device 32 to play the role of a guide member. Further, a lug 70 extends downward from the first shutter 60 and serves as an abutment against which a lug 72*a* projecting from the leading end of collecting device 50** as will be described contacts.

As shown in FIGS. 2 and 3, the collecting device 50 has a casing 72 which is provided with the above-mentioned lug **72*a* at the leading end thereof. The casing 72 has thereinside a portion 74 for discharging the waste toner and a portion 76 for accommodating the waste toner. As shown in FIG. 3, a second screw 78 is disposed in the toner discharging portion 74 for conveying the waste toner T from the cleaning device 32 in a direction indicated by an arrow d. A joint 82 is located in the waste toner accommodating portion 76 to transmit power from an agitator shaft 80 to the second screw 78. An opening 84 is formed through the casing 72 in the discharging portion 74 and has a diameter $D_2$. A second shutter 86 is mounted on the discharging portion 74 of the casing 72 in such a manner as to close the opening 84 when the collecting device 50 is not connected to the cleaning device 32. As shown in FIG. 2, the second shutter 86 has bent walls 88*a* and 88*b* and ribs 90*a* and 90*b* contiguous with the walls 88*a* and 88*b*, respectively. The walls 88*a* and 88*b* are slidable in a direction indicated by an arrow f—f', while being guided by the discharging portion of the casing 72. A spring 92*a* is anchored at one end to at least one of the ribs 90*a* and 90*b* and at the other end to the casing 72 in the vicinity of the lug 72*a***.

The diameter $D_2$ of the collecting device 50 is selected to be greater than the diameter $D_1$ of the cleaning device 32. This prevents the waste toner T from depositing on the wall of the casing 72 around the opening 84 or falling from the casing 72.

The operation of the waste toner collecting device 50 having the above construction will be described with reference to FIGS. 4A, 4B, 5A and 5B.

Figure 5A:
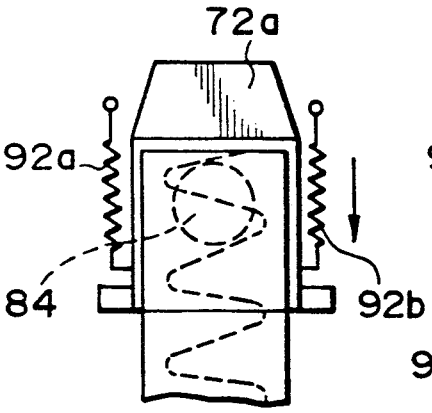
FIGS. 5A and 5B are fragmentary views demonstrating the operation of a second shutter included in the waste toner collecting device.
Figure 5B:
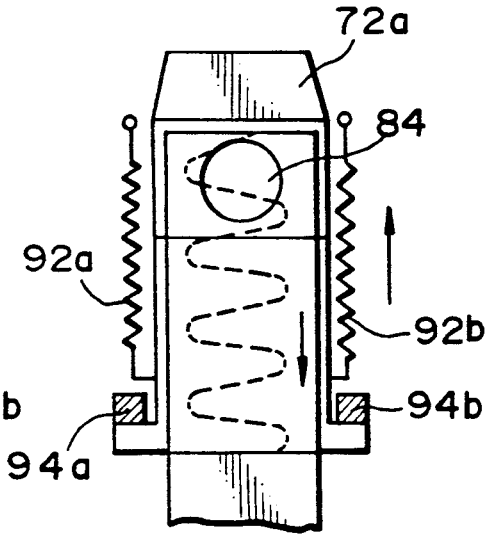

Before the operation of the printer 10, the collecting device 50 is connected to the cleaning device 32, as shown in FIG. 2. As the collecting device 50 is pushed into the printer 10 in the direction f', at least one of the ribs **90*a* and 90*b* of the second shutter 86 abuts against a stop 94*a*. As a result, the opening 84 having been closed by the second shutter 86, as shown in FIG. 5A, is opened, as shown in FIG. 5B. This occurs before the first shutter 60 blocking the opening 58 unblocks it, preparing the collecting device 50 for the entry of the waste toner T. As the collecting device 50 is pushed deeper into the printer 10 toward the cleaning device 32, the lug 72*a* of the device 50 abuts against the lug 70 of the first shutter 60 and urges the first shutter 60 from the position shown in FIG. 4A to the position shown in FIG. 4B. As a result, the opening 62 of the first shutter 60 aligns with the opening 58 of the cleaning device 32. In addition, the opening 84 of the collecting device 50 aligns with the aligned openings 58 and 62, setting up a discharge path for the waste toner T. In such a condition, the toner, paper dust and so on remaining on the belt 18 after image transfer are removed by the cleaning blade 32*a* and temporarily collected in the cleaning device 32 (see FIG. 1). The first screw 54 conveys the collected waste toner to the opening 58 of the cleaning device 32. Then, the waste toner is dropped through the aligned openings 58, 62 and 84 onto the second screw 78. The second screw 78 transports the waste toner T in the direction d. In this manner, the waste toner T is successfully collected in the collecting device 50**.

When the collecting device 50 is pulled out away from the cleaning device 32, the lug **72*a* of the device 50 is brought out of the contact with the lug 70 of the first shutter 60. Consequently, the first shutter 60 is pulled in the direction e by the spring 62 to the position shown in FIG. 4A, whereby the opening 58 is closed to prevent the waste toner T from dropping. Subsequently, the second shutter 86 is released from the stops 94*a* and 94*b* with the result that the second shutter 86 is pulled by the springs 92*a* and 92*b* from the position shown in FIG. 5A to the position shown in FIG. 5B. Therefore, the second shutter 86 closes the opening 84** again.

In summary, it will be seen that the present invention provides a waste toner collecting device which is physically independent of a cleaning device and, therefore, facilitates the disposal of a waste toner. In a portion where the two devices are connected together, a first and a second shutter which open and close respectively an opening formed through the cleaning device and an opening formed through the collecting device cooperate with each other. When the collecting device is connected to the cleaning device, the second shutter opens the associated opening before the first shutter does so. Conversely, the second shutter closes the associated opening after the first shutter has done so when the collecting device is removed from the cleaning device, preventing the waste toner from scattering around in an image recorder.

Various modifications will become possible for those skilled in the art after receiving the teachings of the present disclosure without departing from the scope thereof. For example, the stops **94*a* and 94*b* associated with the second shutter 60 are omissible if the force of the spring 64 is selected to be greater than the force of the springs 92*a* and 92*b***.

What is claimed is:

1. A device incorporated in an electrophotographic image recorder for collecting a waste toner, paper dust and so on which are removed from a photoconductive element by a cleaning device, said device comprising:

a first opening formed through a casing of said cleaning device for dropping the waste toner, paper dust and so on removed from said photoconductive element;

accommodating means constituting a receptacle for accommodating the waste toner, paper dust and so on dropped through said first opening, a portion of said accommodating means being configured as a connecting portion for connecting said accommodating means to said cleaning device, said connecting portion comprising a first lug portion at a leading end thereof;

a second opening formed through said connecting portion of said accommodating means for allowing the waste toner, paper dust and so on dropped through said first opening to enter said receptacle;

first shutter means slidably positioned on the casing of the cleaning device for blocking and unblocking said first opening of said cleaning device and formed with a third opening, said first shutter means comprising a second lug portion; and second shutter means slidably positioned on said accommodating means for opening and closing said second opening of said accommodating means;

said first shutter means and said second shutter means each blocking and unblocking in interlocked relation to connecting and disconnecting operations of said accommodating means and said cleaning device;

wherein said first lug portion abuts against said second lug portion when said accommodating means is moved toward said cleaning device so as to move said first shutter means and unblock said first opening.

2. A device as claimed in claim 1, wherein said second shutter means unblocks before said first shutter means when said accommodating means and said cleaning device are brought into connection, while said second shutter means blocks after said first shutter means when said accommodating means and said cleaning device are brought out of connection.

3. A device as claimed in claim 2, wherein said second opening has a greater diameter than said first opening.

* * * * *